US005257665A

United States Patent [19]

Watkins

[11] Patent Number: 5,257,665

[45] Date of Patent: Nov. 2, 1993

[54] METHOD AND SYSTEM FOR RECOVERING LIQUIDS AND GAS THROUGH A WELL

[75] Inventor: Fred E. Watkins, Houston, Tex.

[73] Assignee: Camco International Inc., Houston, Tex.

[21] Appl. No.: 936,606

[22] Filed: Aug. 27, 1992

[51] Int. Cl.[5] ..... E21B 43/00

[52] U.S. Cl. ..... 166/372; 166/50

[58] Field of Search ..... 166/50, 117.5, 313, 166/372

[56] References Cited

U.S. PATENT DOCUMENTS

| | | | |
|---|---|---|---|
| 2,053,981 | 9/1936 | Villers | 166/313 |
| 3,224,267 | 12/1965 | Harlan et al. | 166/313 X |
| 3,302,721 | 2/1967 | Yetman | 166/313 |
| 3,735,815 | 5/1973 | Myers | 166/313 |
| 4,708,595 | 11/1987 | Maloney et al. | 166/372 X |
| 4,878,539 | 11/1989 | Anders | 166/372 X |

FOREIGN PATENT DOCUMENTS

| | | | |
|---|---|---|---|
| 1006726 | 3/1983 | U.S.S.R. | 166/372 |

*Primary Examiner*—George A. Suchfield

[57] ABSTRACT

A method and system for recovering fluids from a hydrocarbon-bearing subsurface formation includes a first tubing string run into the well and a second tubing string run within the first tubing string. The annulus between the first and second tubing strings is sealed above a liquid level in the well and at least one fluid passageway is provided between the first and second tubing strings at a location between the liquid level and adjacent the annulus seal. The difference of the liquid head between the inside of the second tubing string opposite the at least one fluid passageway and the outside of the second tubing string (i.e. the first and second tubing string annulus) provides the casing annulus-to-tubing differential pressure that forces gas above the annulus fluid level to pass through the at least one fluid passageway and re-enter the fluid stream in the second tubing string. As less gas or more liquid is produced, the liquid level in the annulus rises and less pressure differential is available to force the gas through the at least one fluid passageway; therefore, less gas will flow into the second tubing string fluid. If more gas or less liquid is produced, the liquid level in the annulus will drop; thereby, creating more pressure differential and more gas will pass into the second tubing string. In this manner, a self regulating system is created that prevents liquid loading of the well.

10 Claims, 2 Drawing Sheets 34
36
14
h
30
18
38
10
28
16
14
22
$P_1$
$P_2$
12
16
32
18
20

METHOD AND SYSTEM FOR RECOVERING LIQUIDS AND GAS THROUGH A WELL

BACKGROUND OF THE INVENTION

1. Field of the Invention

The present invention relates to the recovery of liquids and gas from subterranean formations and, more particularly, to the recovery of liquids and gas through a well in a manner to prevent liquid-loading of the well.

2. Setting of the Invention

It is critically important in the economic recovery of liquids and gas from a well to ensure that these fluids are recovered with the least expenditure of energy possible. Further, it is extremely advantageous to recover these fluids in a generally uniform flow rate to not overload and underload downstream fluid processing systems. Many of the wells used for recovering liquids and gas are capable of recovering liquids and gas to the surface with the assistance of the natural energy stored within the subterranean formation. When these fluids from the subterranean formation are recovered through a well, the pressure at the bottom of the well is reduced and additional dissolved gas comes out of solution and is recovered with other fluids. Although many wells will produce such fluids with a fairly uniform daily flow rate, the flow rate of each fluid that enters the well adjacent to the subterranean formation may fluctuate considerably. Even if the flow rate of each fluid into the well is fairly uniform, the undissolved gas is not uniformly distributed in the liquids entering the well. As is most often the case, much of the gas that has separated from the other liquids causes a constantly varying ratio of gas and liquids to enter the well. This non-uniform entry of fluids into the well not only adversely affects the pressure drop of the fluids at this point of entry, but also causes undesirable flow variations as the fluids move up to the surface. Accumulations or slugs of liquid can reduce the flow rate or even prevent fluids from being recovered from the well when the fluid head is greater than the natural energy stored within the subterranean formation.

It is very common for wells that produce a relatively low volume of fluid to "load up", i.e. become incapable of naturally producing fluids therefrom, or flow at a much reduced rate. If a well has become liquid loaded, then artificial lift systems need to be employed, such as rod pumping units, downhole electric submergible pumps or positive displacement pumps. All of these require an undesired use of energy to run such equipment. As an alternative, gas lift systems may be used if sufficient gas is present. An example of using such gas lift systems in horizontal wells is disclosed in the June 1992 American Oil and Gas Reporter, "Gas Lift Usage Can Increase Horizontal Well Production" by Byron Sandel, pages 45–47. While such gas lift systems provide the very desirable benefits of low cost as compared to pumping units, they still cannot overcome the above-described liquid loading problem.

There is a need for a simple and effective method of recovering liquids and gas from a subterranean formation in a manner to prevent liquid loading of the well.

SUMMARY OF THE INVENTION

The present invention has been contemplated to overcome the foregoing deficiencies and meet the above described needs. The present invention is a fluid recovery method and well design or apparatus that reduces the pressure drop of fluids at the point of entry into a well's tubing string and permits a more uniform flow of the fluids through the tubing string. In so doing, the overall losses in energy used to naturally recover fluids is reduced and the production of fluids from the well is more uniform and may increase. Additionally, the well is able to recover fluids over a longer period timer; thereby, delaying any requirement for some form of artificial lift to be utilized in such well.

Specifically, the method of the present invention includes running a first tubing string into the well, such first tubing string can be in the form of a well's surface casing or an additional tubing string that is run into the well. A second tubing string, such as a production tubing string, is run into the well within the first tubing string. The annulus between the first tubing string and the second tubing string is sealed above a liquid level of the well. At least one fluid passageway is provided between the first tubing string and the second tubing string; this fluid passageway being located between the liquid level and the sealing location.

With the provision of the at least one fluid passageway, the difference in liquid head between the inside of the second tubing string opposite the fluid passageway and the outside thereof, i.e. the annulus between the first and second tubing strings, provides an annulus-to-tubing differential pressure that forces gas above the annulus fluid level to pass through this fluid passageway and to re-enter the fluid stream within the second tubing string. As less gas or more liquid enters the well, the liquid level in the annulus rises and less pressure differential is available to force the gas through the fluid passageway. Therefore, less gas will flow into the second tubing string. If more gas or less liquid is produced, the liquid level in the annulus will drop thereby creating a greater pressure differential that forces more gas into the second tubing string. As will be understood by those skilled in the art, this method and apparatus provides a simple self regulating mechanism that prevents undesirable liquid loading of the well.

DETAILED DESCRIPTION OF THE PREFERRED EMBODIMENTS

As described above, the present invention is a method and apparatus for recovering liquids and gas from a hydrocarbon-bearing formation through a well. More particularly, the preferred embodiments, as fully described herein, are designed for recovering liquids and gas from a well in a manner to prevent liquid loading of the well. In one preferred embodiment of the present invention, a first tubing string is run into the well with a second tubing string run into the well within the first tubing string. The annulus between the first and second tubing strings is sealed above a liquid level in the well. At least one fluid passageway is provided between the first and second tubing strings between the liquid level and the sealing location. Fluids then pass upwardly through the second tubing string to the surface.

Figure 1:
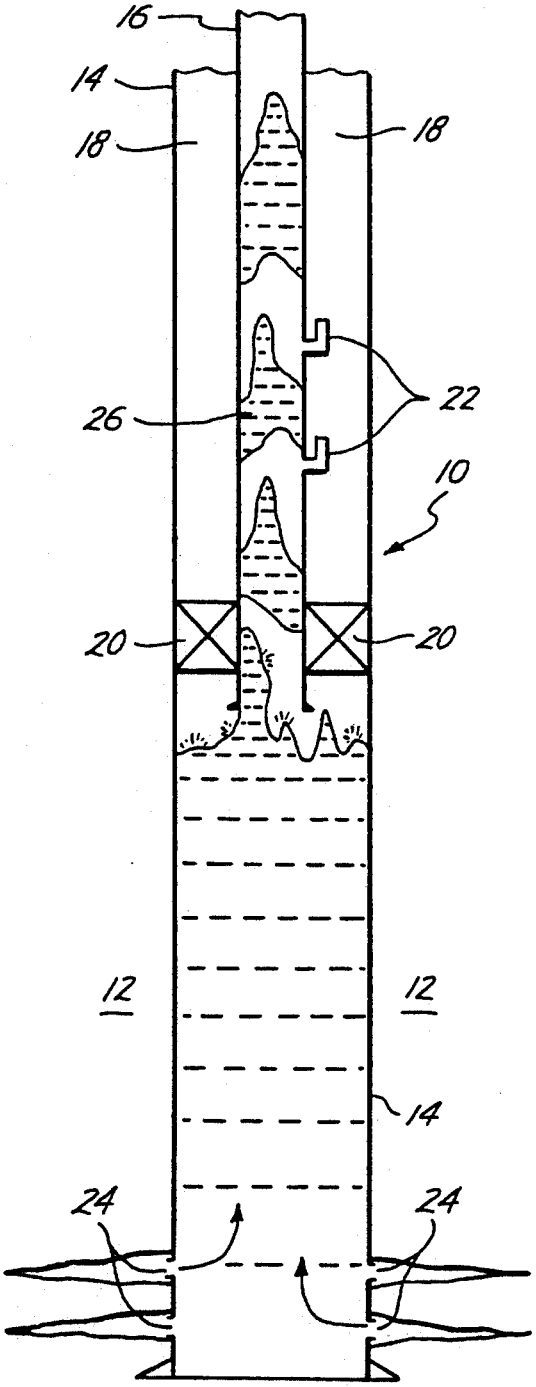
Fig. 1 PRIOR ART
FIG. 1 is a schematic sectional view of a well with gas lift equipment installed for recovering liquids and gas from a subterranean formation in accordance with the Prior Art.

In order to provide a better understanding of the present invention and its benefits over prior art systems, reference is made to FIG. 1. Reference numeral 10 generally indicates a typical prior art well that has been drilled into a hydrocarbon-bearing subterranean formation 12. The well 10 can be completed without a casing, i.e. be an "open hole" completion; however, most wells 10 will include a first tubing string 14 which is cemented and/or sealed in place. A second tubing string 16 is suspended within the first tubing string 14 in any well known manner. An annulus 18 between the first tubing string 14 and the second tubing string 16 is sealed by conventional sealing mechanism or packer 20. The packer 20 can be a permanent or a retrievable packer, as are well known in the art. Further, the second tubing string 16 above the packer 20 may be provided with one or more gas lift valves 22, which can be of any well known configuration and arrangement.

In the operation of the typical well 10, formation fluids, such as water, oil, condensate and gas flow through openings or perforations 24 into the first tubing string 14. As described previously, as the fluids pass upwardly gas comes out of solution and expands causing accumulations or slugs 26 of fluids to pass up the second tubing string 16. If the fluid head of these slugs of fluids is greater than the natural drive energy from the subterranean formation, then the well 10 can dramatically decrease in fluid production rate and become "fluid loaded." It is this adverse fluid loading situation that the present invention has been designed to overcome.

Figure 2:
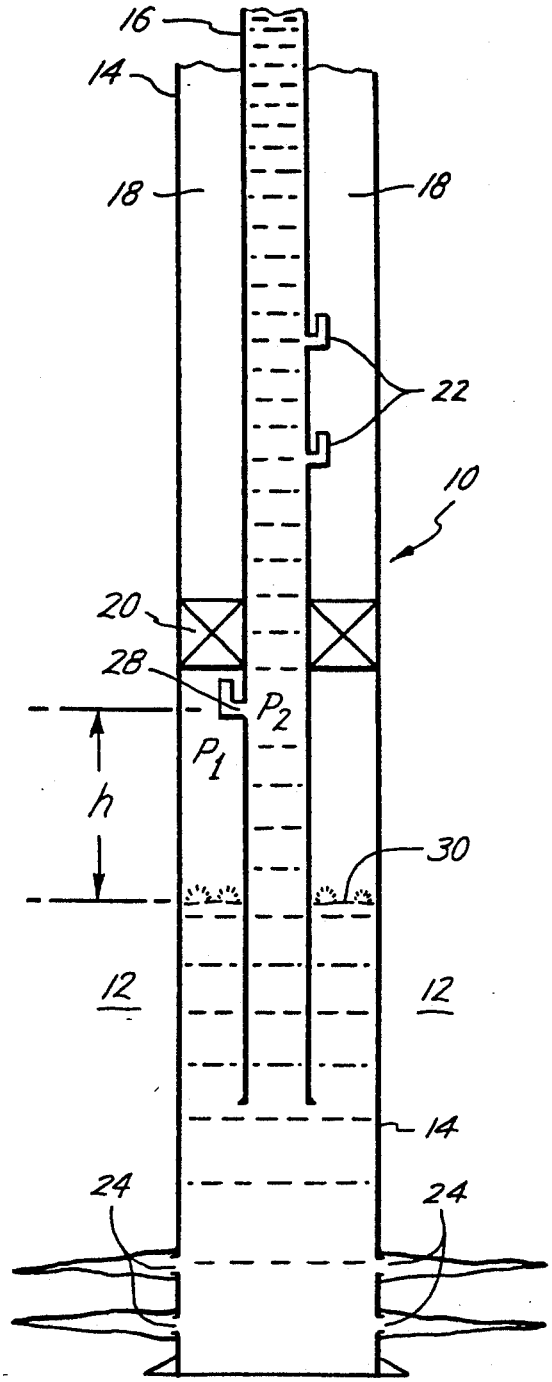
FIG. 2 is a schematic sectional view of a well including gas lift equipment arranged in accordance with one preferred embodiment of the present invention for recovering liquids and gas from a subterranean formation.

In contrast, one preferred embodiment of the present invention is shown in FIG. 2 wherein a well 10 is completed in a manner similar to that of FIG. 1 and includes at least one fluid passageway 28 between the first tubing string 14 and the second tubing string 16. This fluid passageway 28 is located between the packer 20 and an established liquid level 30 of the well 10. The at least one fluid passageway 28 can be a simple orifice or opening, or a secondary gas lift mechanism connected to the tubing string 16, such as, preferably, a variable orifice valve assembly or a retrievable gas lift valve. The at least one fluid passageway 28 is preferably a valve that is retrievable through the second tubing string 16 to permit changing the orifice size within the valve for gas flow optimization. This may be accomplished by installing a side pocket mandrel, such as a Camco Products & Services KBMG series with a Camco RDO-5 orifice valve installed therein. This valve can easily be retrieved by wireline methods, which are well known to those skilled in the art. FIG. 2 shows only one fluid passageway 28; however, two or more such fluid passageways 28 can be included. Such multiple fluid passageways 28 can be radially spaced at approximately the same depth or be radially and longitudinally (i.e. different depths) spaced.

The second tubing string 16 is shown in FIG. 2 as extending below the liquid level 30; however, this is not required since the major requirement on the length of the second tubing string 16 is that there be sufficient length (including any housings of the secondary gas lift mechanisms) below the orifice location to provide sufficient pressure differential for the passage of most of the gas through such orifice.

As shown in FIG. 2, the fluid head between the liquid level 30 and the lowermost of the at least one fluid passageway 28 is referred to as "h". The pressure of gas in the annulus 18 is referred to as $P_1$, and the pressure of fluids (liquid and any entrained gas) within the second tubing string 16 at the passageway 28 is referred to as $P_2$. $P_2$ is also equivalent to $P_1-Ph$, where $Ph=h(ft)\times$fluid gradient (psi/ft.)=psi. With at least one fluid passageway 28 located below the packer 20, fluid flow through the passageway 28 will be regulated according to the magnitude of the fluid head (h). For example, when the fluids being recovered from the subterranean formation have a relatively high gas-to-liquid ratio (such as about 500 $FT^3$/BBL), h will be relatively large (such as about 50 FT) and gas flow through the at least one fluid passageway 28 will be relatively high (such as about 500,000 $FT^3$/DAY). However, with a lower gas-to-liquid ratio (such as about 250 $FT^3$/BBL), h is smaller (such as about 15 FT) and the gas flow through the passageway 28 is less (such as about 250,000 $FT^3$/DAY). As discussed above, the at least one fluid passageway 28 located as described provides a self regulating mechanism for the flow of fluids in a manner to prevent liquid loading of the well.

Figure 3:
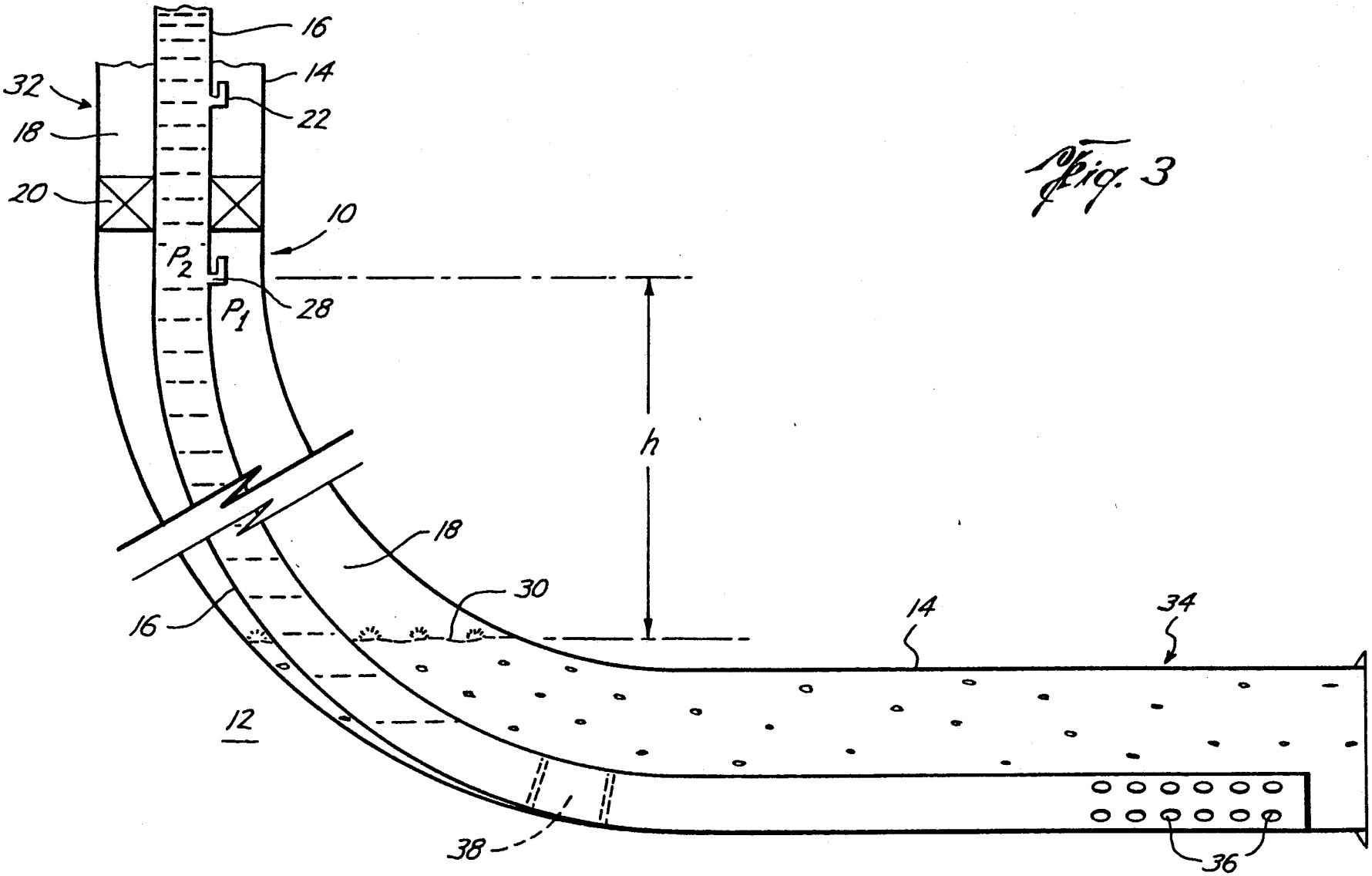
FIG. 3 is a schematic sectional view of a horizontal well with gas lift equipment arranged in accordance with one preferred embodiment of the present invention for recovering liquids and gas from a subterranean formation.

Another preferred embodiment of the present invention is shown in FIG. 3 wherein the well 10 comprises a generally vertical upper section 32 and a generally horizontal lower section 34. With this horizontal well configuration, the operation of the present invention is essentially the same as that show in FIG. 2 and discussed above. The length of the second tubing string 16 is ideally as short as possible to reduce the pressure losses therethrough and still allow the liquid head ("h") that will provide sufficient pressure difference to force gas through the largest practical orifice for the valve. The lowest section of the horizontal section 34 preferably lies on the low side of the first tubing string 14 so that as little gas as possible will enter therein. Further, to reduce the entry of gas into the second tubing string 16, the end section can be closed with perforations 36. As production of fluids from the well 10 declines, a sliding sleeve 38 may be included in the second tubing string 16, and then opened, as is well known to those skilled in the art, to reduce the effective length of the tubing string 16, and; therefore, reduce the pressure drop produced by the flowing fluids.

Wherein the present invention has described in particular relation to the drawings attached hereto, it should be understood that other and further modifications, apart from those shown or suggested herein, may be made within the scope and spirit of the present invention.

What is claimed is:

1. A method of recovering fluids from a hydrocarbon-bearing subterranean formation through a well, comprising:

(a) running a first tubing string into a well;

(b) running a second tubing string into the well within the first tubing string;

(c) sealing the annulus between the first tubing string and the second tubing string above a liquid level within the well, the well includes an upper generally vertical section and a lower generally horizontal section with the second tubing string extending below the sealing location into the generally horizontal section.

2. The method of claim 1 wherein the second tubing string terminates adjacent the liquid level within the well.

3. The method of claim 1 wherein at least one fluid passageway comprises a secondary gas lift mechanism connected to the second tubing string.

4. The method of claim 3 wherein the secondary gas lift mechanism comprises an orifice valve within a retrievable valve assembly connected to the second tubing string.

5. The method of claim 1 wherein the at least one fluid passageway is located within the generally vertical section of the well.

6. An apparatus for recovering fluids from a hydrocarbon-bearing subterranean formation through a well, comprising:

a first tubing string located within a well;

a second tubing string suspended within the well and extending into the first tubing string;

means for sealing an annulus between the first tubing string and the second tubing string above a liquid level of the well; and at least one fluid passageway between the first tubing string and the second tubing string located between the liquid level and the sealing location of the annulus, and the at least one fluid passageway further being located within a generally vertical section of the well and the second tubing string extending into a lower, generally horizontal section of the well.

7. The apparatus of claim 6 wherein the at least one fluid passageway comprises a secondary gas lift mechanism.

8. The apparatus of claim 7 wherein the secondary gas lift mechanism comprises a valve assembly connected to the second tubing string.

9. The apparatus of claim 8 wherein the valve assembly comprises a wireline retrievable valve.

10. The apparatus of claim 6 wherein the at least one fluid passageway includes means for varying rate of fluid passing there through.

* * * * *